United States Patent [19]

Fogleman, Sr.

[11] Patent Number: 4,861,948

[45] Date of Patent: Aug. 29, 1989

[54] INTERLOCK SWITCH WITH LOW ENERGY OPERATING MECHANISM

[75] Inventor: Eric W. Fogleman, Sr., Four Oaks, N.C.

[73] Assignee: Eaton Corporation, Cleveland, Ohio

[21] Appl. No.: 212,353

[22] Filed: Jun. 27, 1988

[51] Int. Cl.[4] ..... H01H 9/26

[52] U.S. Cl. ..... 200/5 B; 200/1 A; 200/50 C

[58] Field of Search ..... 200/1 A, 5 R, 5 B, 5 C, 200/5 D, 5 E, 17 R, 18, 50 R, 50 C, 61.62, 1 R, 6 R, 6 B, 6 BA, 6 BB, 318–328

[56] References Cited

U.S. PATENT DOCUMENTS

| | | | |
|---|---|---|---|
| 4,160,885 | 7/1979 | Ellicott et al. | 200/1 R |
| 4,528,430 | 7/1985 | Lewandowski et al. | 200/61.62 |
| 4,529,852 | 7/1985 | Lewandowski | 200/50 A |
| 4,547,634 | 10/1985 | Leger | 200/50 C |
| 4,575,590 | 3/1986 | Hattori et al. | 200/5 B |
| 4,667,066 | 5/1987 | Ando et al. | 200/1 A |
| 4,717,794 | 1/1988 | Paul et al. | 200/50 A |

*Primary Examiner*—J. R. Scott

*Attorney, Agent, or Firm*—L. Vande Zande

[57] ABSTRACT

A multiple leaf spring interlock switch having a pair of contacts in each side of an A.C. supply inherently biased to open positions and operated to closed positions by a linearly reciprocably movable cam acting only against the biased of the contacts. A latch is operable to alternately latch and release the cam on successive operations to hold the contacts closed or released. An interlock system has plural slides coupled to a rotary cam which is in turn coupled to a lock member to block movement of the linearly movable cam when either slide is in a non-operated position and to release the latch when a slide is moved to a non-operated position while the cam is latched, such action also causing the rotary cam to separate the contacts. An energy storage and release mechanism provides non-reversible momentum for a depressible operation.

23 Claims, 9 Drawing Sheets

INTERLOCK SWITCH WITH LOW ENERGY OPERATING MECHANISM

BACKGROUND OF THE INVENTION

This invention relates to switches for controlling electric appliances which have removable attachments such as vacuum cleaners wherein a dust collecting bag may be removed and a power head may be removed and replaced with an alternate version power head. In particular, this invention relates to electric switches having safety interlocks which opens the switch in the event one of the attachments is removed while the switch is in an ON condition. Still more particularly, the invention relates to switches of the aforementioned type which are insensitive to mechanical shock.

Switches of the aforementioned type utilized on vacuum cleaners or similar appliances are subjected to severe treatment. Attachments for the appliance are removed and replaced in, at best, a casual and often hurried manner. The switch is foot operated whereby the operating forces are strong and abrupt. As a result, operating mechanisms of previous switches of the aforementioned type have been made heavy, or strong, and therefore susceptible to fatigue, short life and breakage. Strong high energy operating mechanisms offset switch-opening operation of safety interlocks responsive to removal of an attachment, and therefore spring forces for the interlocks need to be increased. In use, the appliance may be jolted through collisions or falls, tending to inadvertently open the switch due to mechanical shock. Such tendency is intensified by strong, high energy operating mechanisms. To overcome the problems associated with high energy operating mechanisms, some previous switches of the aforesaid type have incorporated a multiplicity of discrete plunger operated snap action switches on a mounting plate. A mechanical lever system operating mechanism is also mounted on the mounting plate. This type of switch assembly requires a wiring harness and connector assembly, and is ordinarily more expensive than an integral switch package.

SUMMARY OF THE INVENTION

This invention provides an interlock switch for use in an appliance such as a vacuum cleaner wherein the operating mechanism requires low energy for actuating the switch contacts. The low energy operating mechanism allows the contacts to be positively held in an ON condition against mechanical shock and to be readily operated to an OFF condition upon removal of an attachment to the cleaner device. Such low energy mechanism also allows the contacts to be preformed to have a bias toward a normally open condition to improve safety in the event of breakage or malfunction of the switch.

The interlock switch of this invention comprises pairs of normally open contacts operated to a closed condition by a first cam member which drives one of the contacts of each pair into circuit making engagement against the other of the contacts of each pair through a resilient coupling between an operator and the first cam, and a latch which operates automatically to latch the first cam when that cam reaches a predetermined position at which the contacts are closed. Subsequent operation of the switch operator effects release of the first cam and the driven contacts move away from the engaged contacts under their own bias, moving the cam therewith. A second rotary cam is coupled to one or more interlocks and to the other contacts of each pair to move those contacts out of range for engagement by the driven contacts when the interlock members are not operated. The rotary cam also functions to insert a lock member into the path of movement of the first cam to positively prevent contact closing movement. The rotary cam also functions to separate the contacts when closed in the event one of the interlock members subsequently moves to a non-operated position. These and other advantages and features of the interlock switch of this invention will become more apparent when reading the following description and claims in conjunction with the accompanying drawings.

BRIEF DESCRIPTION OF THE DRAWINGS

FIG. 9 is a perspective view of a contact driving power cam and a resilient actuator of the switch mechanism illustrated in the aforedescribed FIGS. 2–8;

DETAILED DESCRIPTION OF THE PREFERRED EMBODIMENT

Figure 1:
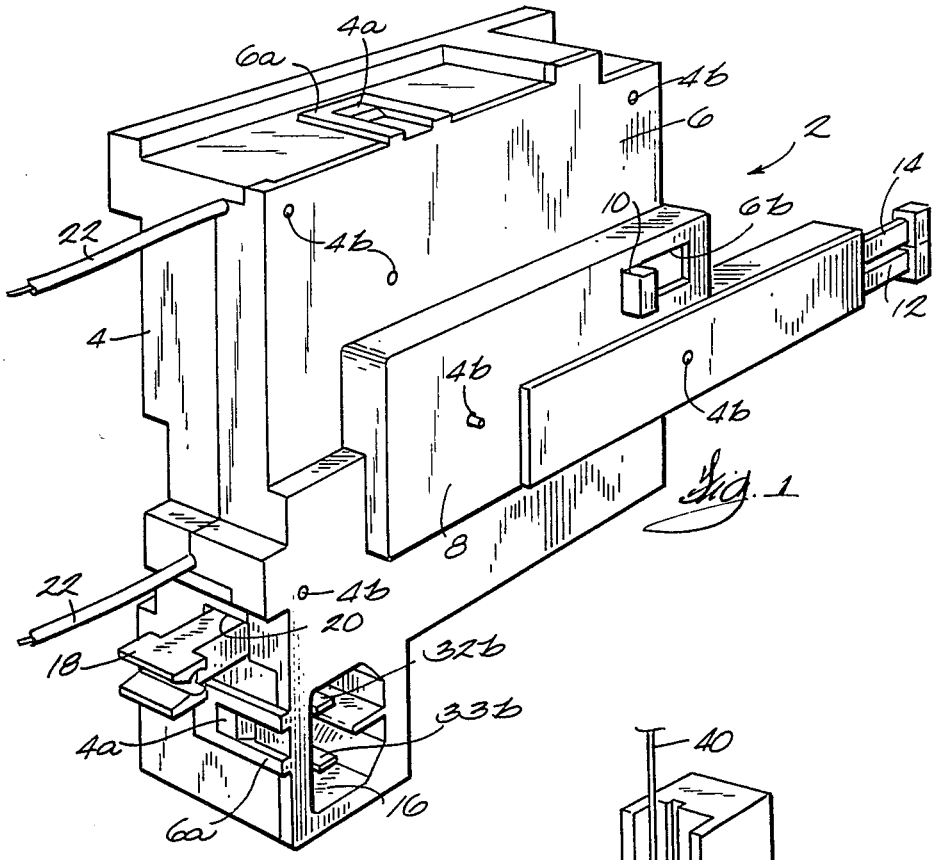
FIG. 1 is a perspective view of the interlock switch constructed in accordance with this invention.

The fully asembled interlock switch 2 of this invention is shown in perspective in FIG. 1. Switch 2 comprises a molded plastic base 4 and a molded plastic cover 6 which have a multiplicity of ribs and bosses formed on their interior surfaces in an arrangement to provide for mounting, guiding and electrically isolating the various components of the switch as will become apparent throughout the following description. Base 4 and cover 6 form a substantially rectangular box having an integral protrusion 8 extending forwardly and beyond the right-hand side thereof to house interlock members 10 and 12 and a speed change rod 14. The housing formed by base 4 and cover 6 also has a depending power cord receptacle 16 formed at the lower left-hand corner thereof. Cover 6 is attached to housing 4 by a plurality of snap together loops 6a formed on cover 6 which engage with projecting tabs 4a formed on base 4. Additionally, base 4 is provided with a plurality of forwardly projecting posts 4b which extend through corresponding openings in cover 6 and are hot riveted over to permanently secure cover 6 to base 4. A switch operator 18 projects outwardly through an opening 20 in the left end wall of the housing. Also projecting through the left end wall of the housing are wire leads 22 which may be connected to the brush terminals of the appliance motor. An opening 6b is provided in cover 6 through which a portion of the interlock 10 projects. Interlock 12 and speed change rod 14 project through openings 24 and 26 in the end of housing protrusion 8.

Figure 2:
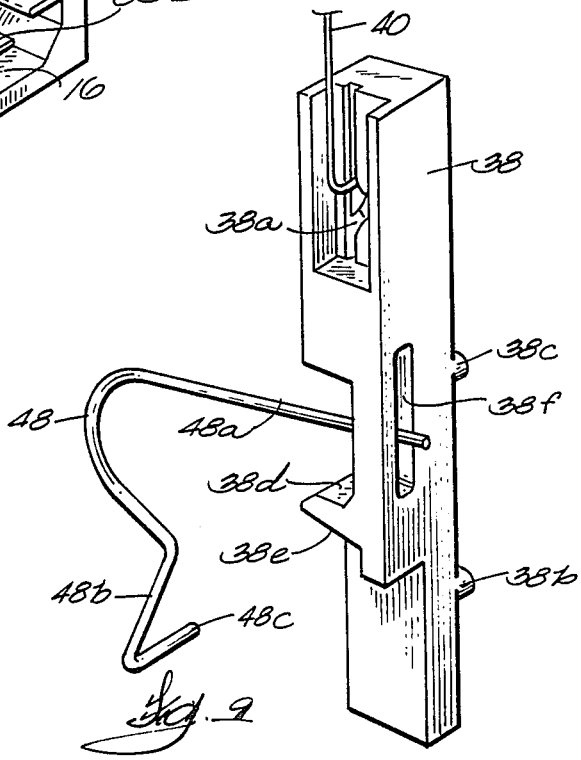
FIG. 2 is a plan view of the interlock switch of this invention having a cover removed therefrom to illustrate the mechanism, showing the switch in an OFF condition with all interlocks and the switch operator in non-operated positions.
Figure 2:
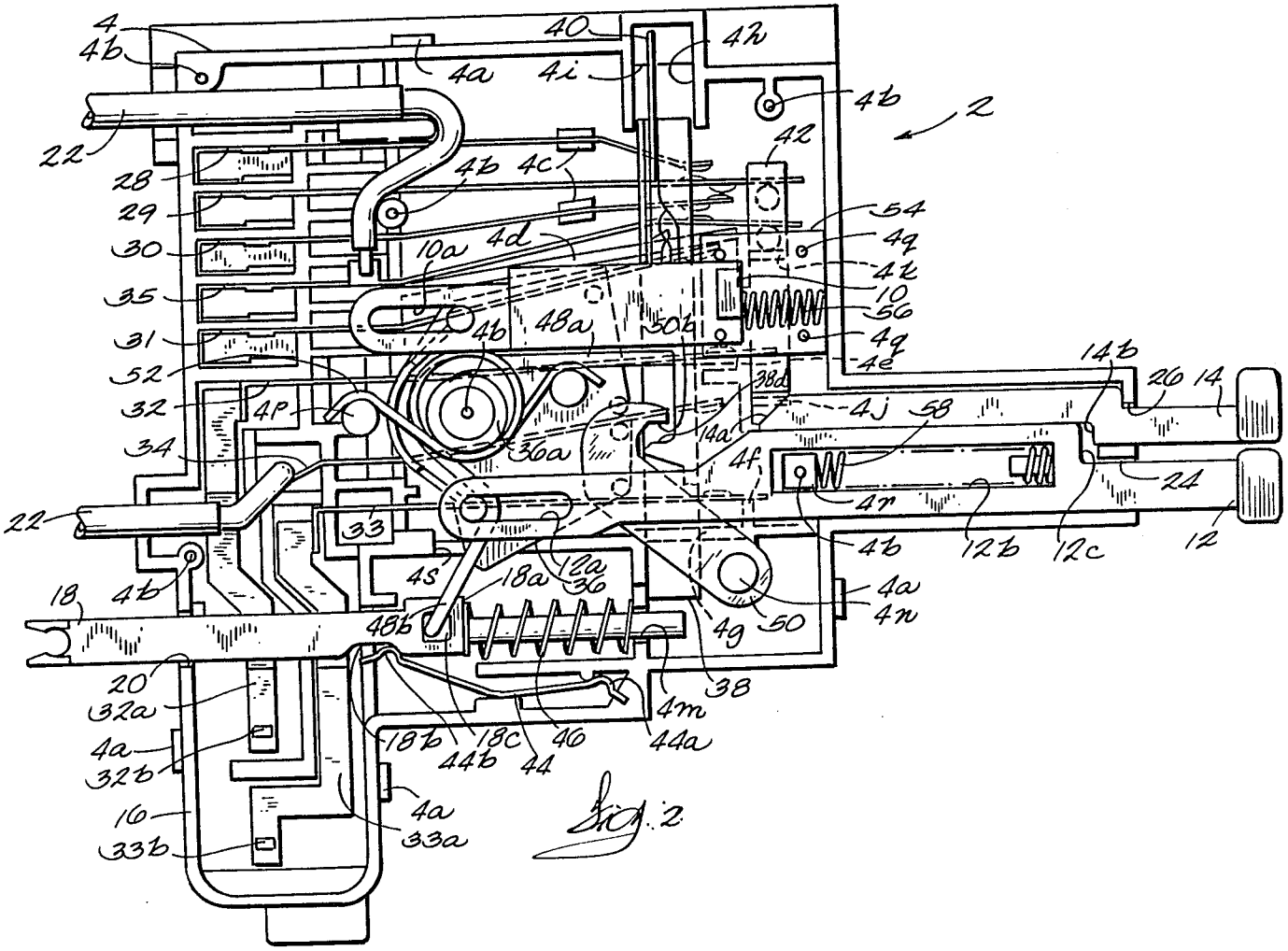

Switch 2 is shown in FIG. 2 with cover 6 removed from base 4 to show the components of the switch more clearly. All the components are assembled within the base 4, and will be described according to the sequence of assembly within the base. Four leaf spring contactor blades 28, 29, 30 and 31 are positioned within pockets and grooves formed in the upper left-hand quadrant of housing 4. The leaf spring blades of these contactor members extend to the right within a large cavity of the base 4 and have one or more contact tips secured at or near their distal ends. Projections 4c are formed in the rear wall of the case 4 to receive intermediate portions of contactor blades 28 and 30 to provide additional support and more firmly affix the location of these resilient leaf spring contact members. Although not shown, the left-hand ends of the contactor blades are formed rearwardly and are disposed within a connector module opening in base 4 to cooperably attach to a mating connector module on the appliance motor, electrically connecting the contactor blades to windings of the motor. Contactor blade 31 is preformed to extend upwardly at its free end and when positioned within housing 4, contactor blade 31 is biased against the underside of a forwardly projecting wall 4d (FIG. 2) formed on the interior rear wall of housing 4.

A pair of power contactor leaf spring blades 32 and 33 are also installed within suitable pockets along the lefthand side of base 4, the contactor blades 32 and 33 extending to the right and preformed downwardly. When installed, the blades 32 and 33 are deflected upwardly against stop walls 4e and 4f formed in base 4 against the inherent bias provided by the preform. Contactor blades 32 and 33 also have integral bus portions 32a and 33a, respectively, at the left-hand ends thereof which extend downwardly into power cord receptacle 16. Bus portions 32a and 33a have connector prongs 32b and 33b affixed at their respective distal ends to project forwardly within the receptable opening. Contactor blades 32 and 33 are electrically hot when the switch is connected to an A.C. supply.

Another leaf spring contactor blade 34 is welded to the bared end of one of the wire conductors 22 and is positioned within a pocket and grooves formed at the lefthand side of base 4 to extend rightwardly into cooperating relationship with contactor blade 33. Blades 33 and 34 have contact tips riveted to their distal ends for cooperative engagement. Contactor blade 34 is preformed to extend upwardly, away from contactor blade 33. Another contactor blade 35 is attached by welding or the like to the other wire conductor 22 and is positioned in a pocket located between the pockets for contactors 30 and 31. Contactor blade 35 extends to the right and is preformed to bear against the upper surface of wall 4d (FIG. 2), therefore being biased away from contactor 30. A contact tip is affixed at the right-hand end of contactor blade 35. The left-hand end of contactor blade 35 is formed rearwardly for disposition within the aforementioned connector module opening in base 4 similarly to the left-hand ends of contactor blades 29–31 for electrical connection with motor windings.

Figure 10:
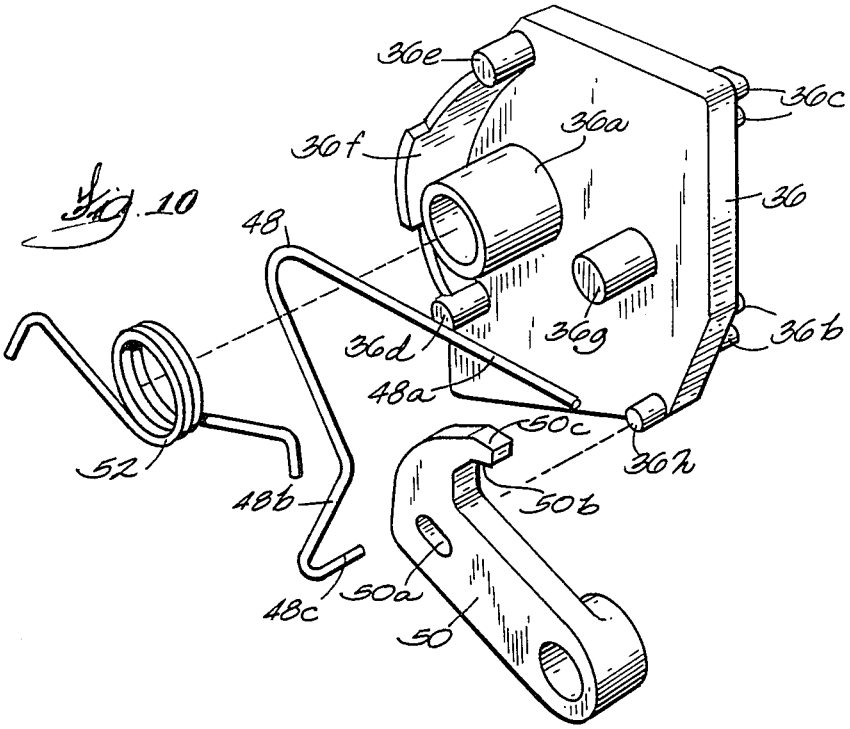
FIG. 10 is an exploded perspective view of a rotary cam, resilient actuator, torsion spring and lock member of the switch mechanism of this invention.

A rotary interlock cam 36 (best shown in FIG. 10) having forwardly extending coaxial hollow cylindrical bearing 36a is positioned in base 4 such that the rearwardly extending trunion is received over a cylindrical boss (not shown) on the rear surface of base 4. The forwardly extending bearing 36a will be rotatably received over a corresponding cylindrical boss (not shown) on cover 6 when the cover is assembled to base 4 to rotatably journal cam 36. The various details of rotary interlock cam 36 are more clearly shown in the exploded perspective view of FIG. 10, and reference should be had thereto for an understanding of these features. Interlock cam 36 has two pairs of closely spaced bosses 36b and 36c projecting from the rear surface thereof to receive the contactor blades 34 and 31, respectively, between, thereby coupling these contactor blades 34 and 31 to the rotary interlock cam 36 for movement therewith. A pair of forwardly projecting cylindrical pins 36d and 36e are formed on the front surface of rotary interlock cam 36 for engagement by interlock slide members 10 and 12 as will be more fully described later. A forwardly projecting arcuate rib 36f extends between pins 36d and 36e, the rib having recessed end segments adjacent each of the pins to provide resting surfaces for the interlock members 10 and 12 as will be described later. A third cylindrical pin 36g extends forwardly from the front surface of rotary interlock cam 36 near the center thereof and a fourth cylindrical pin 36h also extends forwardly from the front surface of the rotary interlock cam 36 near the lower right-hand corner thereof.

Figure 11:
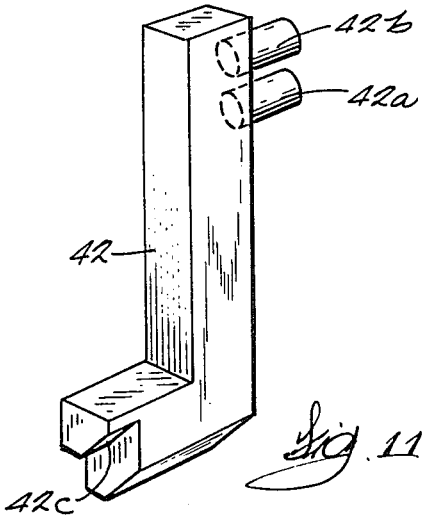
FIG. 11 is a perspective view of the speed change contact cam of the switch mechanism of this invention.

An elongated generally rectangular power cam 38 (best shown in FIG. 9) is mounted for linear reciprocal movement within a lower slot 4g (FIG. 2) and an upper pocket 4h provided in base 4. An abutment surface 4i within the pocket 4h serves as a positive stop for upward travel of power cam 38. Referring to FIG. 9, the upper end of power cam 38 is provided with a latch wire cam track 38a which defines an essentially W-shaped path. The individual legs of the latch wire cam track 38a are formed in stepped, successively deepening increments. A latch wire 40 having its opposite ends formed at right angles to the body thereof has one of the formed ends positioned in a hole within pocket 4h, and the other end of the latch wire rests in the cam track 38a. Wire 40 is not constrained against lateral movement left and right as viewed in FIG. 2 except as it may be constrained by the cam track 38a. However, wire 40 is biased into the plane of the paper in the illustration of FIG. 2 such that the end of the wire in the track is biased into the respective successively deepening levels of the track to follow the track around to a return point. Power cam 38 has a pair of projections 38b and 38c extending from the rear surface thereof which engage contactor blades 33 and 32, respectively, when power cam 38 is moved upwardly. The forward surface of power cam 38 is relieved along the left-hand side thereof to define a perpendicular latching surface 38*d* and a cam surface 38*e*. An elongated slot 38*f* is also formed in the power cam near the center thereof. A second generally rectangular elongated cam 42 (shown best in FIG. 11) is positioned in base 4 for longitudinal movement by slots 4*j* and 4*k* (FIGS. 2). Cam 2 is a speed change cam and has cylindrical pin-like projections 42*a* and 42*b* extending rearwardly from its back surface in abutting engagement with contactor blades 35 and 29, respectively. The lower end of speed change cam 42 is provided with a beveled surface 42*c* which is arranged to cooperate with a beveled end 14*a* of speed change rod 14 as will be described more fully hereinafter.

A gullwing-like spring 44 having curved ends 44*a* and 44*b* is positioned within an opening in base 4 along the lower edge thereof such that the end 44*a* if fixed within base 4 and the end 44*b* projects freely upwardly. Switch operator 18 is positioned in base 4 and guided for longitudinal linear movement within opening 20 and an internal opening 4*m*. A helical compression spring 46 is disposed over the right-hand end of operator 18 beteen a shouldered surface 18*a* on the operator 18 and a forwardly projecting wall in base 4 in which opening 4*m* is formed to bias the operator leftwardly to an extended position with respect to the housing. The underside of operator 18 is provided with a slot 18*b* in which the rounded end 44*b* of spring 44 nests. An opening 18*c* is also provided in the body of operator 18 near the shouldered projection 18*a*. A somewhat S-shaped actuator wire 48 (see FIGS. 9 and 10) having a long straight rightwardly extending upper end 48*a* is inserted through slot 38*f* in power cam 38. The upper curve of S-shaped actuator wire 48 is disposed around the cylindrical bearing 36*a* of rotary interlock cam 36 between that bearing 36*a* and rib 36*f*. The lower curve of S-shaped actuator wire 48 is disposed around pin 36*d* of rotary interlock cam 36, and the lower end of wire 48 is formed at a right angle to provide an offset end 48*c* which is inserted within opening 18*c* of operator 18. Depression of operator 18 (rightward movement in FIG. 2) into the housing rotates actuator wire 48 counterclockwise to raise the end 48*a*, thereby driving power can 38 upwardly into pocket 4*h* until the upper end thereof abuts stop surface 4*i*. Continued depression of operator 18 flexes the actuator wire 48 to permit over-travel of operator 18 without damaging the mechanism.

A J-shaped locking member 50 (see FIG. 10) is pivotally mounted at the distal end of its shank upon a forwardly projecting pin 4*n* (FIG. 2) within base 4. An elongated slot 50*a* is provided in the shank of locking member 50 near the junction of the shank with the rounded hook portion thereof. Slot 50*a* is disposed over forwardly projecting pin 36*h* on rotary interlock cam 36. The distal end of the hook portion of locking member 50 has a flat latching surface 50*b* which is disposed at an acute angle to a radial line directed from the axis of rotation about pin 4*n* to the latching surface 50*b*, this latching surface cooperating with surface 38*d* when the locking member is rotated into the position shown in FIG. 2 to block upward movement of power cam 38. The outer edge of the hook portion of locking member 50 is provided with an angular cam surface 50*c* which cooperates with angled surface 38*e* on power cam 38 in a manner to be described hereinafter.

A torsion spring 52 (see FIG. 10) is next assembled to rotary interlock cam 36 by disposing the loop portion thereof over the bearing 36*a* of cam 36. The right-hand leg of spring 52 projects from the loop along the rear portion thereof and extends around pin 36*g* of cam 36 and the left-hand leg extends from the forward side of the loop to rest upon the forward surface of rib 36*f* and engage a forwardly projecting pin 4*p* formed on base 4. Spring 52 imparts a clockwise bias to cam 36.

A flat separator plate 54 is positioned over two pins 4*q* (FIG. 2) projecting through aligned openings in the plate 54 within housing 4 over the speed change cam 42 and is secured in place by the cover 6 to separate the speed change cam 42 from interlock slide member 10 which is disposed for linear movement within the housing. Interlock slide member 10 has an elongated slot 10*a* at its left-hand end which is disposed over pin 36*e* of cam rotary interlock 36, the left-hand end of interlock slide 10 resting upon the upper recessed surface of rib 36*f*. Separator plate 54 and upper recessed surface of rib 36*f* raise the rear surface of interlock slide member 10 above the forward surface of power cam 38 so as not to interfere with movement of either member. A helical compression spring 56 is disposed between the right-hand end of interlock member 10 and the right-hand end wall of base 4 to bias the interlock slide member 10 leftwardly wherein the right-hand end of slot 10*a* engages pin 36*e* to impart a counterclockwise rotation to rotary interlock cam 36 against the bias of torsion spring 52.

Interlock slide member 12 is placed within the base 4 such that a slot 12*a* at the left-hand end thereof is disposed over pin 36*d* of rotary interlock cam 36 with the rear surface of the left-hand end of slide 12 resting on the other recessed surface at the lower end of rib 36*f*. Slide 12 has a second elongated slot 12*b* centrally located in the body thereof disposed over a projection 4*r* of base 4 with a helical compression spring 58 disposed within slot 12*b* between the right-hand end thereof and the projection r*r* to bias the slide 12 rightwardly to an extended position from the housing. In this position, the left-hand end of slot 12*a* engages pin 36*d* to also impart a counterclockwise rotation to the rotary interlock cam 36 against the bias of torsion spring 52. Speed change rod 14 is an elongated member disposed parallel and adjacent slide 12 within the housing and having an angled cam surface 14*a* at its lefthand end which cooperates with cam surface 42*c* on speed change cam 42. An offset shoulder 14*b* on speed change rod 14 is spaced from a similar offset shoulder 12*c* on interlock slide member 12 to engage that surface upon depression of speed change rod 14, thereby picking up slide 12 when speed change rod 14 is depressed against the bias of spring 58. With the parts assembled in base 4 as heretofore described, cover 6 is assembled over the base 4 such that the loops 6*a* (FIG. 1) snap over the projecting tabs 4*a* of the base to hold the same in place. In this position, the posts 4*b* extend through corresponding holes in the cover and are hot riveted over to firmly secure the cover 6 to the base 4 as aforedescribed.

The operation of the interlock switch 2 will now be described with particular reference to FIGS. 2 through 8. In FIG. 2, interlock slide members 10 and 12 are shown in their non-operated positions wherein they hold rotary interlock cam 36 in its counterclockwise position as determined by engagement of the upper edge of cam 36 with the wall 4*d* in base 4. In this position, lock member 50 is rotated clockwise to bring latching surface 50*b* into alignment with the path of movement of surface 38*d* on power cam 38, thereby blocking movement of power cam 38 in the upward direction. Projections 36*b* and 36*c* (FIG. 3) hold contactor blades 34 and 31 in their uppermost position. Operator 18 assumes its extended position due to the bias of spring 46.

Figure 3:
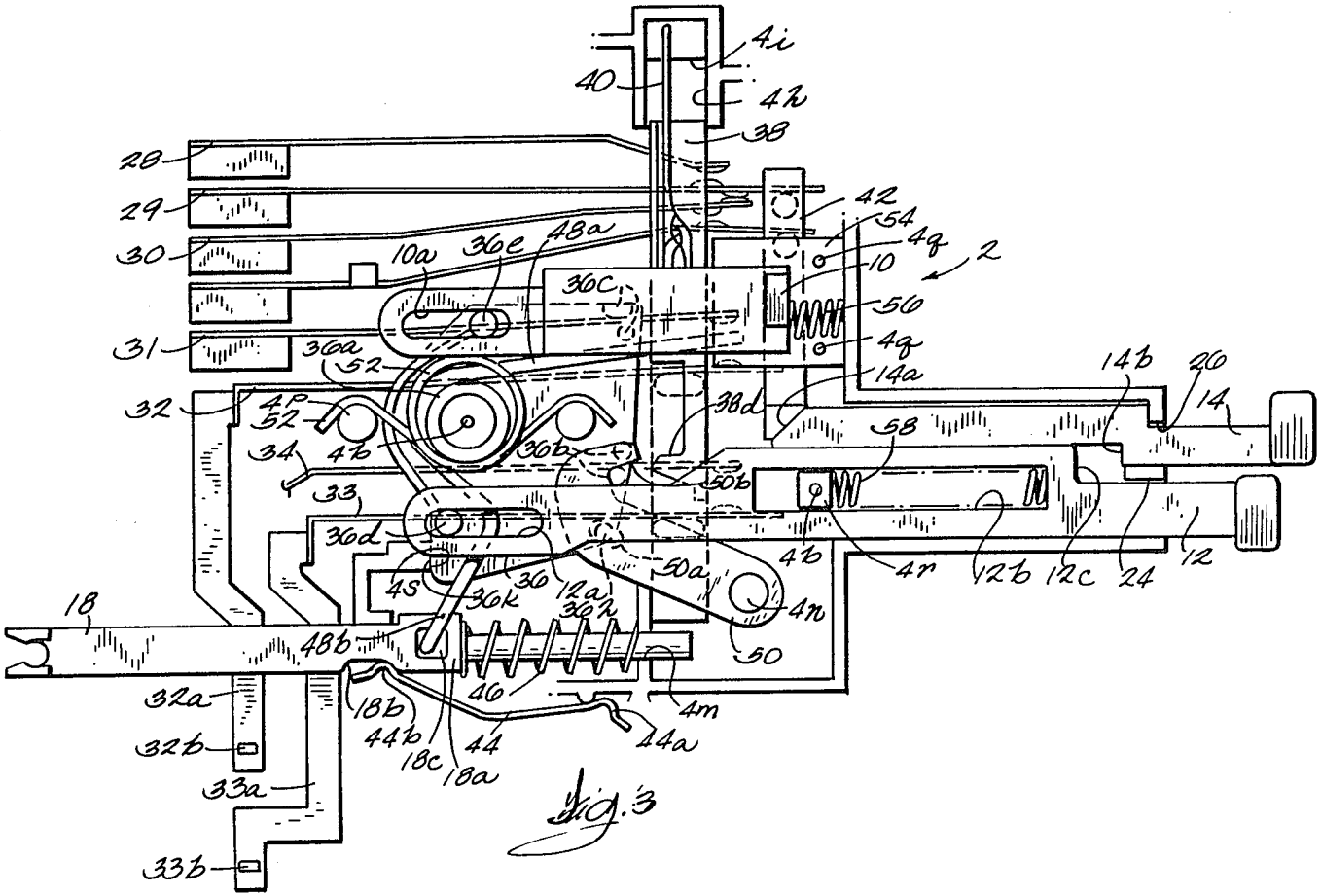
FIG. 3 is a view similar to FIG. 2 showing only the elements of the mechanism and certain features of the housing, the mechanism being shown in an operational sequence from that of FIG. 2 wherein both interlocks are operated.

Referring now to FIG. 3, interlock member 10 is moved rightward to its operated position against the bias of spring 56 by attachment of the bag of the vacuum cleaner to the outlet thereof, thereby moving slot 10*a* rightwardly to release pin 36*e* of cam 36. Interlock slide 12 is operated to move inwardly against the bias of spring 58 by the attachment of the power head to the vacuum cleaner device. The inward movement of interlock slide 12 moves slot 12*a* leftward to release pin 36*d* of cam 36. When both interlock slide members 10 and 12 have been moved to release the pins 36*d* and 36*e*, rotary interlock cam 36 rotates clockwise under the bias of spring 52 to a rest position wherein a lower surface 36*k* (FIG. 3) abuts a stop surface 4*s* formed in base 4. This rotational movement of rotary interlock cam 36 moves lock member 50 counterclockwise about post 4*n* by the connection between pin 36*h* of rotary interlock cam 36 and slot 50*a* of lock member 50, thereby holding latch surface 50*b* out of the path of movement of cooperating surface 38*d* of power cam 38. The aforedescribed clockwise rotation of cam 36 also drives contactor blades 34 and 31 downwardly toward contactor blades 33 and 32 by means of the coupling connections 36*b* and 36*c*, respectively.

Figure 4:
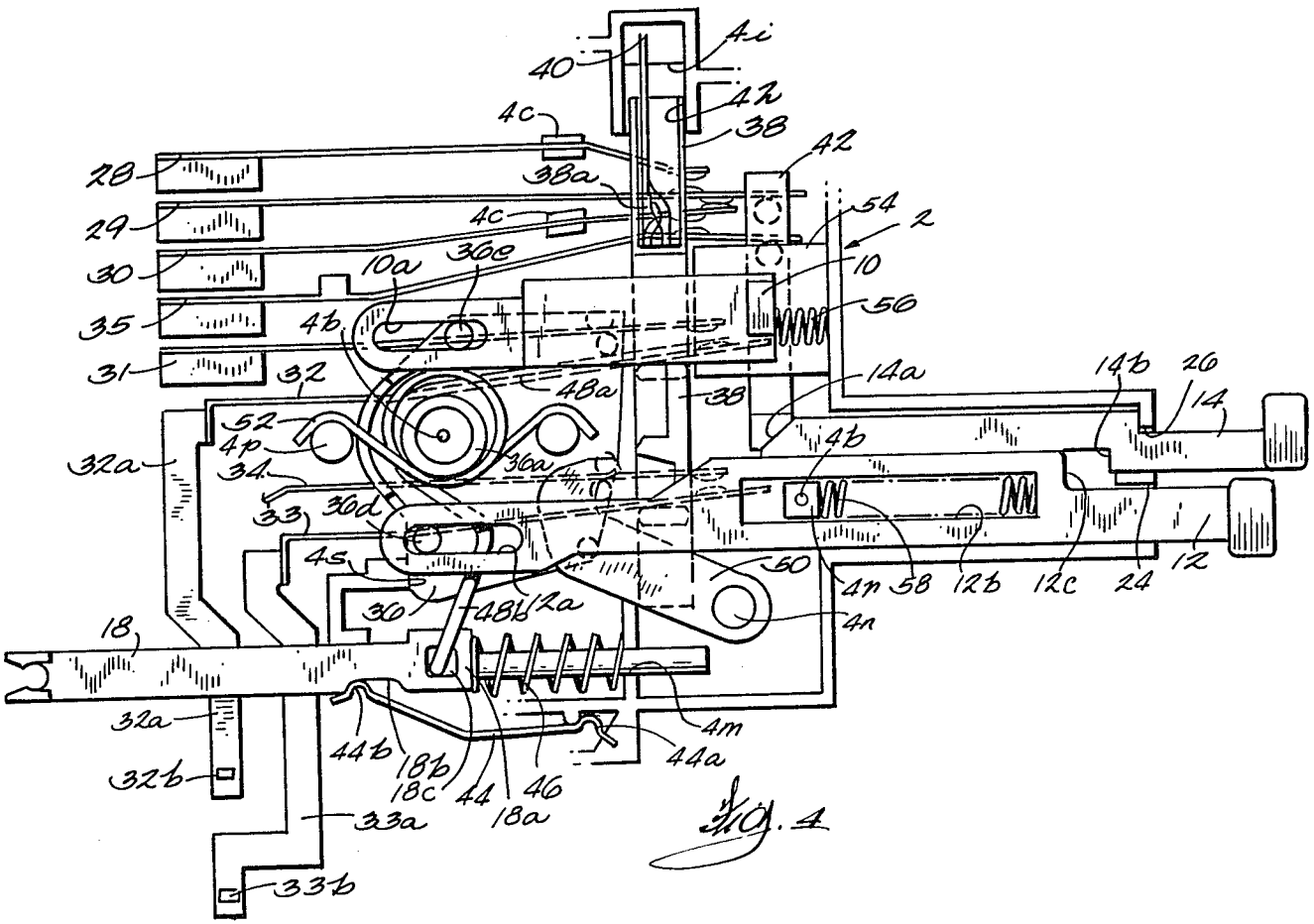
FIG. 4 is a view similar to FIG. 3 and in sequence therefrom showing the switch operator and the contacts partially moved toward an ON condition.
Figure 5:
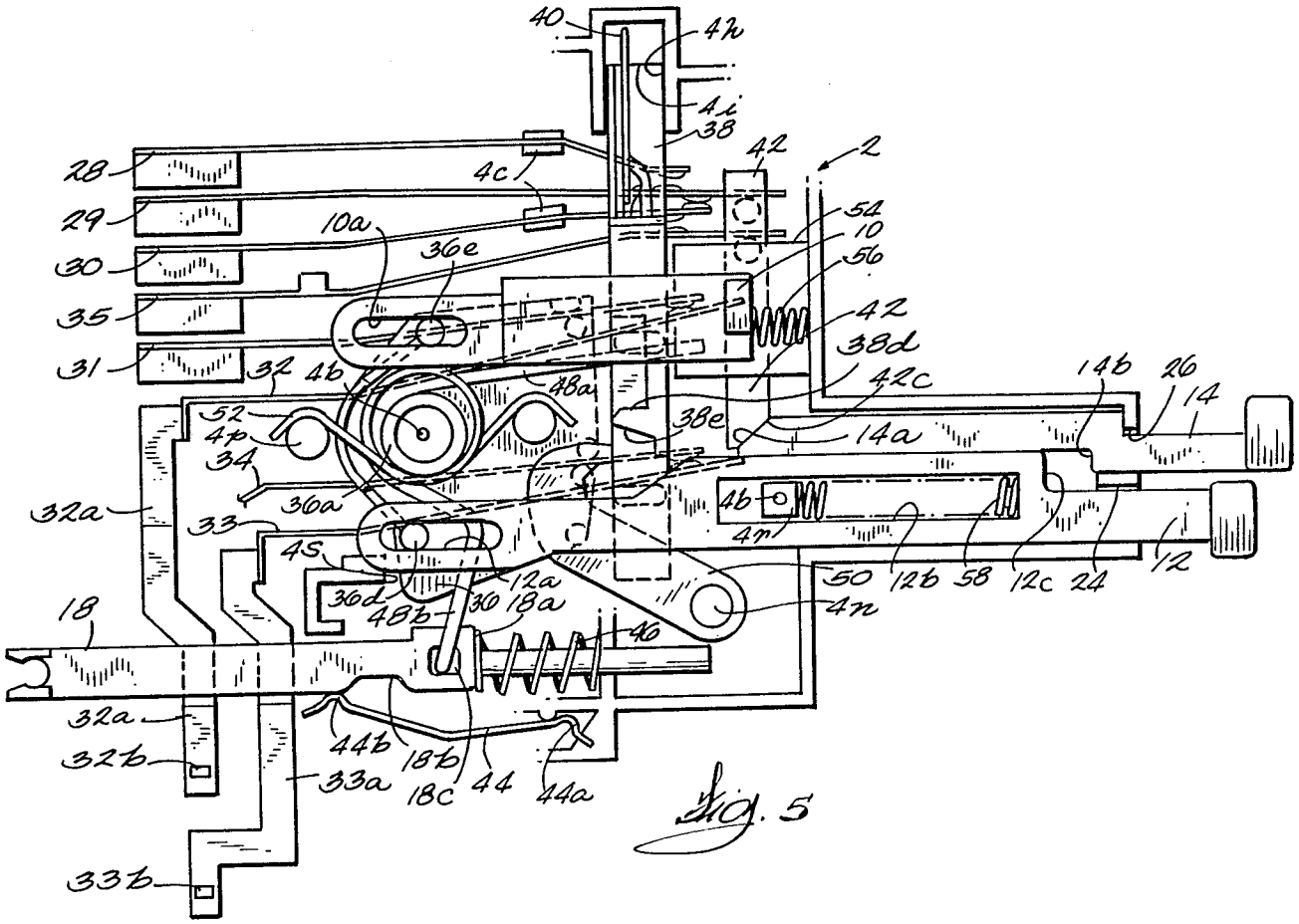
FIG. 5 is a view similar to FIG. 4 and in sequence therewith showing the switch operator and contacts moved to a full ON condition and a latch member in a reset latched condition.
Figure 6:
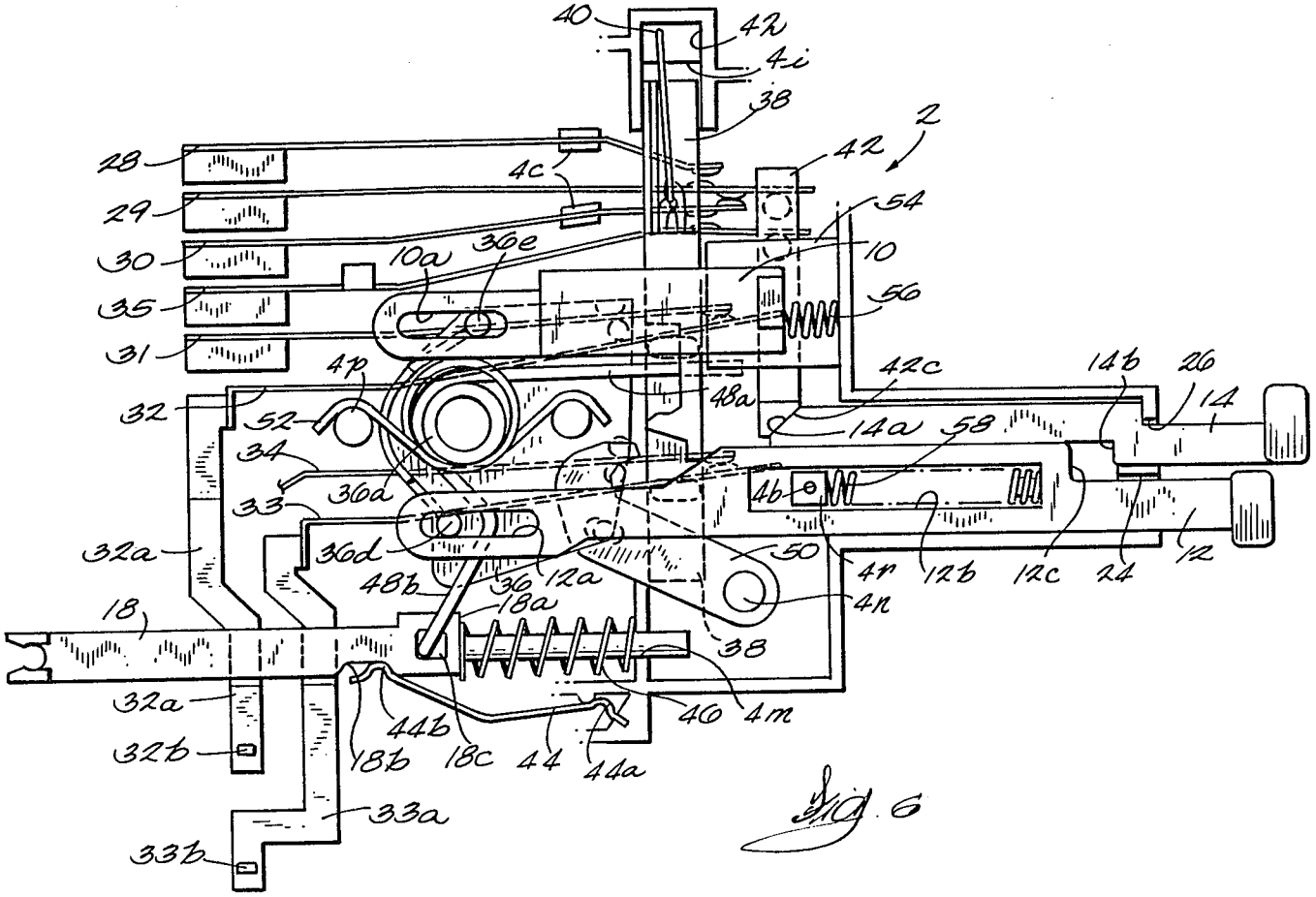
FIG. 6 is a view similar to FIG. 5 and in sequence therewith showing the switch operator returned to its extended position, the latch engaged in a locked condition and the contacts in an ON condition.

Referring next to FIG. 4, operator 18 is depressed inwardly causing slot 18*b* to travel along the rounded end 44*b*of spring 44 with negligible resistance provided by the spring 44 until the left-hand trailing end of slot 18*b* comes into contact with the rounded end 44*b*. This movement begins to move power cam 38 upwardly by rotating the resilient actuator 48 counterclockwise, thereby moving contactor blades 33 and 32 upwardly toward contactor blades 34 and 31, respectively. Continued force applied to the projecting end of operator 18 to depress the operator 18 is then resisted by the engagement of end 44*b* within the left-hand end of slot 18*b* until a threshold value of depression force is attained, whereafter end 44*b* is forced out of slot 18*b* and operator 18 moves rightwardly or further depressed with a sudden movement to the position shown in FIG. 5. This final depression of operator 18 continues to drive power cam 38 upward, bringing contact blades 32 and 33 into circuit completing engagement with contact blades 34 and 31, respectively. Power cam 38 moves upwardly resisted only by the light bias of contactor blades 32 and 33 until the upper end thereof abuts stop surface 4*i* whereupon the lower end of latch wire 40 drops into the reset leg of cam track 38*a*. Continued depression of operator 18 flexes actuator wire 48 to prevent structural damage to the operator 18 and to the power cam 38. Release of the depression force on operator 18 permits it to move to its extended position under the bias of spring 46, thereby permitting actuator wire 48 to rotate clockwise and release its upward force on power cam 38. Power cam 38 drops slightly until the lower end of latch wire 40 drops into the recessed surface at the center apex of the W-shaped cam track 38*a* (FIG. 6). In this position, latch wire 40 latches power cam 38 against further downward movement and positively holds the contactor blades 33 and 32 in circuit completing engagement with contactor blades 34 and 31, respectively, as shown in FIG. 6. A successive depression of operator 18 will again drive power cam 38 upwardly against stop surface 4*i* through resilient actuator wire 48, thereby causing the lower end of latch wire 40 to move downwardly along the angled leg from the apex of the W-shaped cam, thereby releasing the locking affect of latch wire 40 on the power cam 38. Subsequent release of operator 18 will allow it to move again leftwardly to its extended position under the bias of spring 46, thereby permitting actuator wire 48 to move clockwise and release the actuating force on power cam 38. Power cam 38 moves downwardly under the bias of contactor blades 33 and 32, thereby causing the lower end of latch wire 40 to move into the right-hand leg of the W-shaped surface cam which is continuous with a return leg ramped upwardly to bring the end of latch wire 40 into the original or first leg of the cam track 38*a*.

Figure 7:
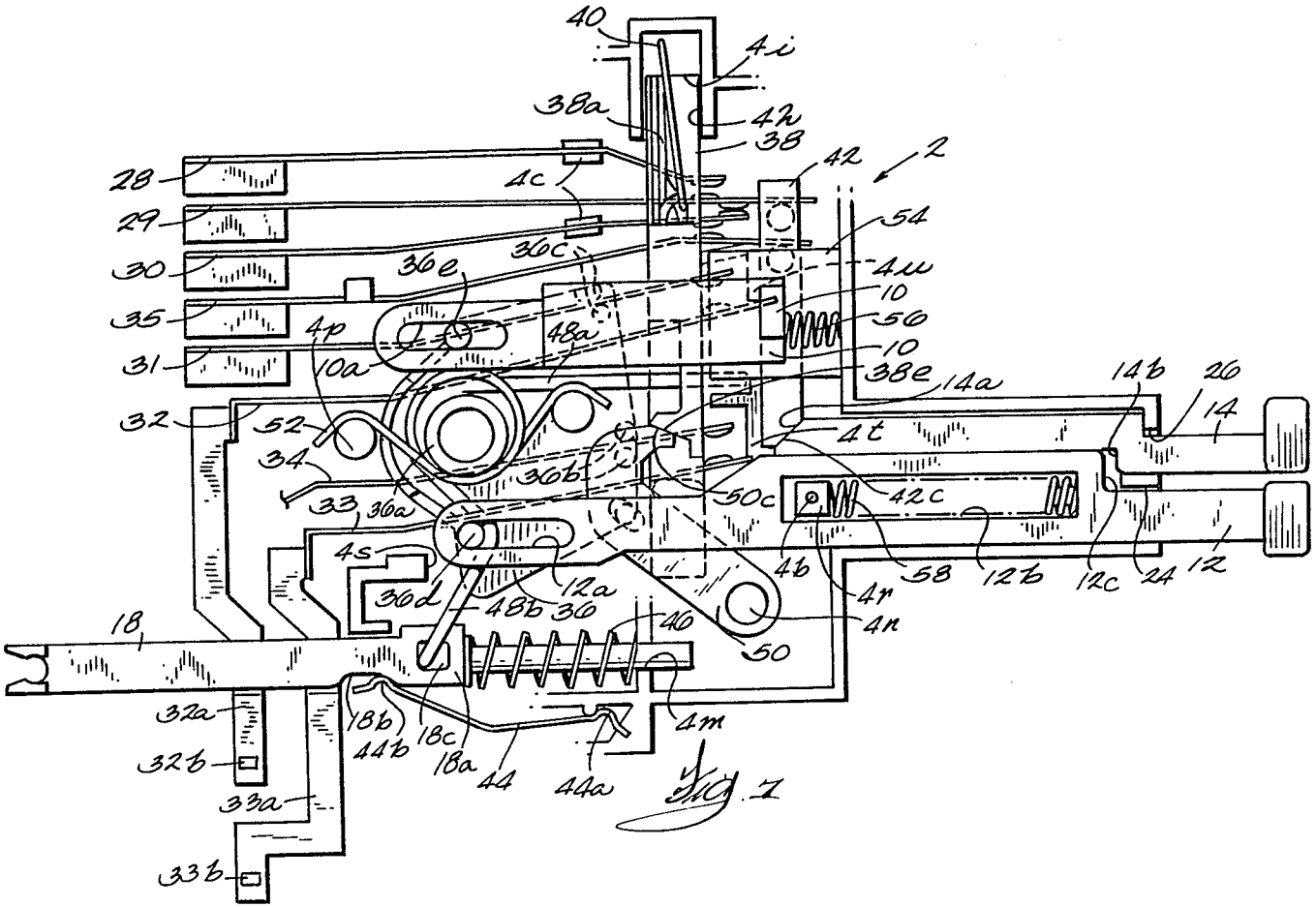
FIG. 7 is a view similar to FIG. 6 and in sequence therewith showing the switch contacts moved to an open condition as a result of one of the interlock members being released to a non-operated position.

Referring next to FIG. 7, in the event that either the bag or the power head is detached from the vacuum cleaner device while the switch is in its ON condition, the respective interlock slide member 10 or 12 will move to it non-operated position shown in FIG. 2. In that position, the slot 10*a* or 12*a* moves to engage the respective pin 36*e* or 36*d* of rotary interlock cam 36, thereby imparting a counterclockwise rotation to the rotary interlock cam 36 against the bias of torsion spring 52. This rotary motion of rotary interlock cam 36 rotates lock member 50 clockwise such that cam surface 50*c* thereof engages with cam surface 38*e* of power cam 38 to raise power cam 38 upwardly against the stop surface 4*i*, thereby moving the lower end of latch wire 40 out of the center apex of W-shaped cam track 38*a* into the right-hand leg thereof. The low energy resistance to upward movement of power cam 38 provided by contactor blades 33 and 32 permits the use of lighter action springs 56 and 58 while still affording sufficient force near the end of their respective operating lengths to drive power cam 38 upwardly to release latch 40. Lock member 50 will hold power cam 38 in this position until the non-operated interlock slide member 10 or 12 is again moved to its operated position. The rotational movement of rotary interlock cam 36 also carries contactor blades 34 and 31 upwardly by virtue of the couplings 36*b* and 36*c*, respectively, out of engagement with the contactor blades 33 and 32, respectively, which are stopped from further upward movement by engagement of their distal ends with stop surfaces 4*t* and 4*u* in base 4, thereby opening the circuit of the switch in both sides of the A.C. supply and turning off the motor of the vacuum cleaner device.

Movement of the non-operated interlock slide member 10 or 12 to its operated position will cause the slot 10*a* or 12*a* of that slide to release the respective pin 36*e* or 36*d* of rotary interlock cam 36, thereby enabling the rotary interlock cam 36 to rotate clockwise under the bias of spring 52 and carry lock member 50 out of engagement with power cam 38. Power cam 38 then moves downwardly due to the bias of contactor blades 33 and 32 and the release of latch wire 40 to assume the position shown in FIG. 2, whereupon the switch 2 may again be operated by depression of operator 18.

Figure 8:
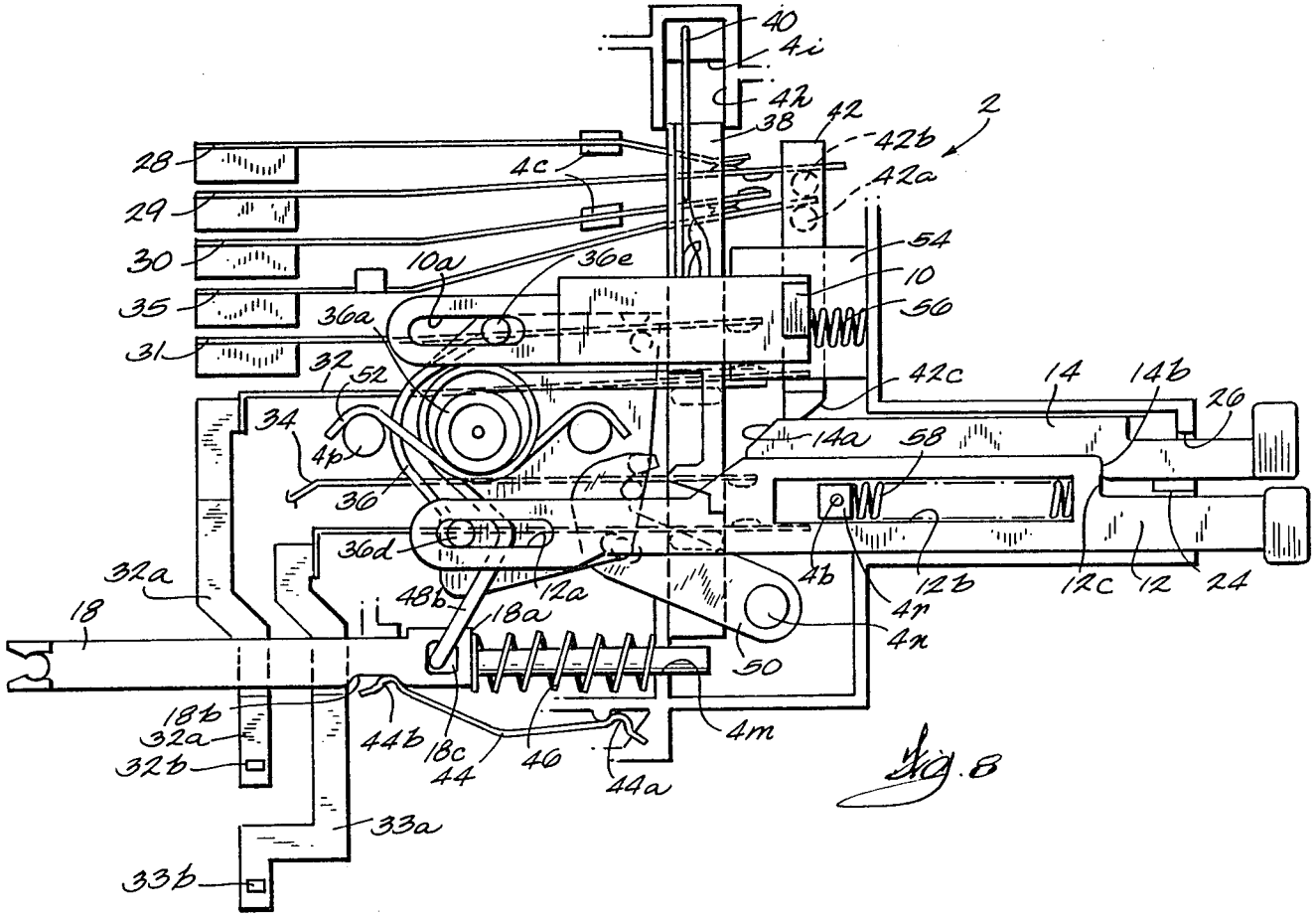
FIG. 8 is a view like FIG. 3 showing the switch with the contacts in an OFF condition, the interlocks moved to operated positions and additionally showing a speed change switch in an actuated condition.

FIG. 8 show operation of the speed change rod 14 which is depressed by attachment of an appropriate alternate power head. Depression of rod 14 causes offset shoulder 14b to engage shoulder 12*c* of interlock slide member 12, thereby to drive interlock slide member 12 leftward to reset the operating mechanism to the position of FIG. 2. Rod 14 drives speed change cam 42 upwardly by the interaction of respective cam surfaces 14a and 42c. Upward movement of speed change cam 42 causes contactor blade 29 to move upwardly into engagement with contactor blade 28, thereby separating engagement of contactor blade 29 from contactor blade 30, and causes contactor blade 35 to move upwardly into engagement with contactor blade 30. This change in connections between the contactor blades 28, 29, 30 and 35 changes the connections to the windings of the motor, causing the motor then to run at a high speed.

The interlock switch hereinbefore described provides a low energy operating mechanism for controlling the main contacts and for positively latching them closed. A plurality of interlocks are interconnected requiring each to be operated in order to operate the switch to an ON condition and release of any interlock to a non-operated position operates the switch to an OFF condition and maintains it OFF until the respective interlock is again in an operated position and the switch operator is subsequently operated. Although the interlock switch 2 of this invention has been described in a preferred embodiment, it is to be understood that it is susceptible of various modifications without departing from the scope of the appended claims.

I claim:

1. An interlock switch having a low energy operating mechanism comprising:

contact means biased to a normally open condition;

cam means reciprocally movable between first and second positions closing said contact means in said second position;

an operator biased to an extended position operable to a depressed position;

means coupling said operator and said cam means, depression of said operator moving said cam means to said second position, said contact means biasing said cam means to said first position upon return of said operator to said extended position;

latch means alternately latching and releasing said cam means in said second position upon successive depressions of said operator; and interlock means normally blocking movement of said cam means from said first position to said second position, said interlock means being movable to a non-blocking position; and second operator means operable to move said interlock means to said non-blocking position.

2. The interlock switch defined in claim 1 wherein a positive stop is provided for said cam means at said second position and said coupling means is resilient, said coupling means being flexed upon continued depression of said operator after said cam means engages said positive stop.

3. The interlock switch defined in claim 2 wherein said latch means comprises a substantially W-shaped track in a surface of said cam means, bottom surfaces of respective legs of said track being at successively deeper levels, and a latch wire fixed at one end and having a hook at an opposite end, said hook being received in said track biased against respective bottom surfaces thereof.

4. The interlock switch defined in claim 1 wherein said interlock means comprises a pivotally supported lock member having a surface engageable with a cooperating surface on said cam means, said lock member surface engaging said cam means surface from one side of said cam means and said lock member being pivotally supported at an opposite side of said cam means, said lock member surface being perpendicular to a direction of movement of said cam means when engaged with said cam means cooperating surface.

5. The interlock switch defined in claim 4 wherein said interlock means further comprises rotary cam means and at least one reciprocally movable slide member, said rotary cam means coupling said slide member to said lock member, said slide member being biased to a first position wherein said lock member surface is disposed in a blocking position to be engaged by said cam means cooperating surface and said slide member being operable to a second position wherein said lock member surface is held free of said cam means cooperating surface as said cam means moves to said second position thereof.

6. The interlock switch defined in claim 5 wherein said lock member and said cam means have respective cooperable cam surfaces engaged when said slide member returns to said first position from said second position thereof while said cam means is in said second position, said engagement of said cooperable cam surfaces moving said cam means similarly to a successive depression of said operator, thereby causing said latch means to release said cam means.

7. The interlock switch defined in claim 5 wherein said rotary cam means is rotatably biased oppositely to said slide member bias to hold said lock member surface free of said cooperating surface when said slide member is in said second position thereof, and bias of said slide member dominates bias of said rotary cam means when no operating force is applied to said slide member.

8. The interlock switch defined in claim 7 wherein said interlock means comprises two of said reciprocally movable slide members, each coupled to said lock member by said rotary cam means, both of said slide members being in respective said second positions to enable said rotary cam means to hold said lock member surface free of said cam means cooperating surface, and either of said slide members in a respective said first position effecting rotation of said rotary cam means against the bias thereof to hold said lock member surface in blocking position to be engaged by said cam means cooperating surface.

9. The interlock switch defined in claim 1 wherein:

said interlock means comprises a rotary cam, at least one reciprocally movable slide member coupled to said rotary cam, and a lock member coupled to said rotary cam, said slide member being biased to a first position wherein said lock member is moved to its blocking position by said rotary cam, said slide member being operable to a second position wherein said lock member is moved out of said blocking position by said rotary cam;

said contact means comprises pairs of leaf spring contacts, each pair comprising a first and a second contact normally disposed in spaced relation, said first contacts being operatively coupled to said reciprocally movable cam means and said second contacts being operatively coupled to said rotary cam, and fixed limit stops for each of said first contacts defining a limited range of movement of said first contacts toward said second contacts short of engagement with said second contacts when the latter are in their normally disposed relation:

wherein rotary movement of said rotary cam when said slide member is moved to said second position thereof moves said second contacts toward said first contacts to positions within said limited range of movement to be engaged by said first contacts when said cam means moves to said second position, and wherein movement of said slide means to said first position rotates said rotary cam to move said second contacts away from said first contacts out of said limited range of movement.

10. The interlock switch defined in claim 9 wherein said contact means comprises two of said pairs of leaf spring contacts, each of said pairs being connected to an opposite side of an A.C. electric power supply connector to effect a circuit break in both sides of a supply when said switch is operated to an open condition.

11. An interlock switch having a low energy operating mechanism comprising:

a housing;

at least two pairs of cooperable contacts each comprising first and second leaf spring contacts mounted in said housing in spaced relation;

a power cam reciprocally movable in said housing having means thereon engaging said first leaf spring contacts and closing said first contacts against said second leaf spring contacts when said power cam is moved from a first position toward a second position, an operator guided for reciprocal movement in said housing and biased to an extended position through an opening in said housing;

actuator means coupling said operator and said power cam, said actuator means moving said power cam to said second position thereof in response to depression of said operator and permitting return of said powe cam to a first position thereof upon return of said operator to its extended position;

latch means operable to alternately latch and release said power cam in said second position thereof upon successive depressions of said operator; and interlock means normally blocking movement of said power cam from said first position torward said second position, said interlock means comprising at least one slide member reciprocally movable in said housing and having a portion thereof extending through a second opening in said housing, said slide member being biased to a non-operated position and movable to an operated position wherein said interlock means is non-blocking of movement of said power cam.

12. The interlock switch defined in claim 11 wherein said interlock means and said power cam have respective cooperable cam surfaces engagable when said power cam is latched in said second position and said slide member is subsequently moved to said non-operated position to move said power cam similarly to a successive depression of said operator to effect release of said latch means.

13. The interlock switch defined in claim 11 wherein:

said housing comprises limit stops engagable by said first contacts defining a limited range of movement of said first contacts toward said second contacts;

said interlock means comprises a rotary cam rotatably mounted in said housing biased to a first position, said slide member being coupled to said rotary cam and holding said rotary cam in a second position in a non-operated position of said slide member; and means on said rotary cam coupling said second leaf spring contacts thereto, said rotary cam holding second contacts out of said limited range of movement of said first contacts in said second position of said rotary cam and moving said second contacts within said limited range of movement in said first position of said rotary cam.

14. The interlock switch defined in claim 13 wherein spring biased return of said slide member to said non-operated position when said first contacts are closed against said second contacts rotates said rotary cam to move said second contacts out of said limited range of movement, thereby effecting separation of said first and second contacts.

15. The interlock switch defined in claim 14 wherein said interlock means further comprises a lock member pivotally mounted in said housing, said lock member having a latch surface engagable with a cooperable surface on one side of said power cam effecting said blocking of movement of said power cam, and means coupling said lock member to said rotary cam to move said lock member between said blocking position when said rotary cam is in said second position and a non-blocking position when said rotary cam is in said first position.

16. The interlock switch defined in claim 15 wherein a pivot axis of said lock member is located on an opposite side of said power cam from said cooperable surface.

17. The interlock switch defined in claim 16 wherein said lock member and said power can have respective cooperable cam surfaces engagable when said power cam is latched in said second position and said slide member is subsequently moved to said non-operated position to move said power can similarly to a successive depression of said operator to effect release of said latch means.

18. The interlock switch defined in claim 17 wherein said actuator means comprises a resilient wire coupled at one end of said operator and at an opposite end to said power cam, said wire being flexible to permit movement of said operator relative to said power cam when the latter is blocked against movement or at an extreme of its movement to said second position thereof to protect said operating mechanism from damage.

19. The interlock switch defined in claim 18 further comprising energy release means in said housing operable upon predetermined depression of said operator to resist further depression until applied force effecting said depression reaches a threshold, said energy release means thereafter abruptly releasing said operator and said threshold force applying a non-reversible momentum to said operator to move said power cam to said latched second position.

20. The interlock switch defined in claim 18 further comprising a leaf spring detent in said housing resiliently engaging a surface of said operator within a linear slot, said detent being passive to depression of said operator until a trailing end of said slot abuts said detent whereupon said detent resists further depression of said operator until an applied force effecting depression of said operator attains a threshold value, said detent spring thereafter moving out of said slot to abruptly release said operator, said threshold force value applying non-reversible momentum to said operator to move said power cam to said latched second position.

21. The interlock switch defined in claim 18 wherein said first contacts are each connected to opposite sides of an A.C. electric power supply connector.

22. The interlock switch defined in claim 18 wherein said interlock means comprises a pair of said slide members, either of said slide members holding said rotary cam in said second position in a non-operated position of the respective slide member.

23. The interlock switch defined in claim 22 wherein both said slide members must be in their respective operated positions to permit biased movement of said rotary cam to said first position thereof.

* * * * *